US009911524B2

(12) United States Patent
Tanaka et al.

(10) Patent No.: US 9,911,524 B2
(45) Date of Patent: Mar. 6, 2018

(54) CHIP RESISTOR AND METHOD FOR MANUFACTURING THE SAME

(71) Applicant: ROHM CO., LTD., Kyoto (JP)

(72) Inventors: Kosaku Tanaka, Kyoto (JP); Takashi Nozaka, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 109 days.

(21) Appl. No.: 15/006,642

(22) Filed: Jan. 26, 2016

(65) Prior Publication Data

US 2016/0240291 A1 Aug. 18, 2016

(30) Foreign Application Priority Data

Feb. 17, 2015 (JP) ..... 2015-028565

(51) Int. Cl.

| | |
|---|---|
| ***H01C 1/012*** | (2006.01) |
| ***H01C 7/20*** | (2006.01) |
| ***H01C 1/142*** | (2006.01) |
| ***H01C 7/00*** | (2006.01) |
| ***H01C 17/242*** | (2006.01) |
| *H01C 17/00* | (2006.01) |

(52) U.S. Cl.

CPC ..... *H01C 7/20* (2013.01); *H01C 1/142* (2013.01); *H01C 7/003* (2013.01); *H01C 17/242* (2013.01); *H01C 17/006* (2013.01)

(58) Field of Classification Search

CPC ..... H01C 7/20; H01C 1/142; H01C 7/003; H01C 17/242; H01C 17/006

USPC ..... 338/309, 195

See application file for complete search history.

(56) References Cited

U.S. PATENT DOCUMENTS

| | | | | |
|---|---|---|---|---|
| 3,808,575 | A * | 4/1974 | Brandt | H01C 1/144 338/262 |
| 5,621,240 | A * | 4/1997 | Ellis | H01C 17/003 257/379 |
| 6,522,236 | B1 * | 2/2003 | Ries | H01L 39/16 338/13 |
| 8,111,130 | B2 * | 2/2012 | Tsukada | H01C 1/012 338/195 |
| 8,319,598 | B2 * | 11/2012 | Zandman | H01C 1/014 338/195 |
| 9,460,834 | B2 * | 10/2016 | Croci | G01L 9/0052 |
| 2007/0096864 | A1 * | 5/2007 | Fujimoto | H01C 1/16 338/309 |
| 2015/0077216 | A1 * | 3/2015 | Frerejean | H01C 17/06 338/285 |

FOREIGN PATENT DOCUMENTS

| | | |
|---|---|---|
| JP | 5544824 | 7/2014 |

* cited by examiner

*Primary Examiner* — Kyung Lee

(74) *Attorney, Agent, or Firm* — Hamre, Schumann, Mueller & Larson, P.C.

(57) ABSTRACT

A chip resistor includes: a resistor body having a front surface and a mounting surface which face in opposite directions; a pair of electrodes which are disposed on both sides of the resistor body with the resistor body sandwiched therebetween and are in electrical conduction with the resistor body; and a protective film covering a portion of the resistor body, wherein a plurality of grooves, which does not penetrate through the resistor body, is formed in the front surface of the resistor body.

36 Claims, 14 Drawing Sheets

CHIP RESISTOR AND METHOD FOR MANUFACTURING THE SAME

CROSS-REFERENCE TO RELATED APPLICATION

This application is based upon and claims the benefit of priority from Japanese Patent Application No. 2015-28565, filed on Feb. 17, 2015, the entire contents of which are incorporated herein by reference.

TECHNICAL FIELD

The present disclosure relates to a chip resistor for use in various types of electronic devices and a method for manufacturing the chip resistor.

BACKGROUND

One type of chip resistor having low resistance which is suitable for current detection uses a metal plate resistor body made of a Cu—Ni alloy or a Ni—Cr alloy to achieve low resistance in the order of mΩ.

In such a chip resistor, an adjustment is made to achieve target resistance by forming a trimming groove in a portion of the metal plate resistor body sandwiched between a pair of electrodes by means of laser machining using a laser trimming device. For such a chip resistor, there is a need to provide a higher precision of resistance at a demand for further advancement of products.

For example, there has been proposed a method for achieving the target resistance of the chip resistor by forming the trimming groove in the portion of the metal plate resistor body by means of punching instead of laser machining. However, since the position and shape of punching holes for formation of the trimming groove are determined depending on a sheet metal plate which is a collection of metal resistor plates, this method has a difficulty in performing the resistance adjustment with high accuracy based on the individual metal resistor plates. In addition, since there is a need for an additional dedicated device to form the punching holes, there are problems related to investment and device development in association with the necessity of a new production facility for introduction of the device.

SUMMARY

The present disclosure provides some embodiments of a chip resistor which is capable of adjusting target resistance with high accuracy while utilizing an existing production facility.

According to one embodiment of the present disclosure, there is provided a chip resistor including: a resistor body having a front surface and a mounting surface which face in opposite directions; a pair of electrodes which are disposed on both sides of the resistor body with the resistor body sandwiched therebetween and are in electrical conduction with the resistor body; and a protective film covering a portion of the resistor body, wherein a plurality of grooves, which does not penetrate through the resistor body, is formed in the front surface of the resistor body.

In some embodiments, a direction of the plurality of grooves is a direction perpendicular to a direction of current flowing through the resistor body.

In some embodiments, an interval between the plurality of grooves is 50 to 100 μm.

In some embodiments, the resistor body has a serpentine shape when viewed from top.

In some embodiments, a thickness of the resistor body is 50 to 150 μm.

In some embodiments, the resistor body is made of an alloy containing Cu, Mn and Ni.

In some embodiments, the pair of electrodes covers a portion of each of the resistor body and the protective film.

In some embodiments, the pair of electrodes includes an inner electrode which is in electrical conduction with the resistor body and covers a portion of the protective film, an intermediate electrode covering the inner electrode, and an outer electrode covering the intermediate electrode.

In some embodiments, the inner electrode is made of a Ni—Cr alloy.

In some embodiments, the intermediate electrode and the outer electrode are formed from a plating layer.

In some embodiments, the outer electrode is formed from a Sn plating layer.

In some embodiments, the intermediate electrode includes a first intermediate electrode covering the inner electrode and a second intermediate electrode covering the first intermediate electrode.

In some embodiments, the first intermediate electrode is formed from a Cu plating layer.

In some embodiments, the second intermediate electrode is formed from a Ni plating layer.

In some embodiments, the protective film is made of a thermosetting resin.

In some embodiments, the protective film is made of a polyimide resin.

In some embodiments, the chip resistor further includes a substrate having a main surface and a mounting surface which face in opposite directions, wherein the resistor body is mounted on the substrate under a state where the mounting surface of the resistor body and the mounting surface of the substrate face each other.

In some embodiments, the substrate is an electrical insulator.

In some embodiments, the substrate is made of alumina.

In some embodiments, the substrate is made of a glass epoxy resin.

In some embodiments, the resistor body is mounted on the substrate under a state where the resistor body is buried in the substrate.

In some embodiments, the chip resistor further includes an adhesive layer sandwiched between the mounting surface of the substrate and the mounting surface of the resistor body.

In some embodiments, the adhesive layer is an electrical insulator.

In some embodiments, the adhesive layer contains an epoxy resin.

According to another embodiment of the present disclosure, there is provided a method for manufacturing a chip resistor, including: preparing a sheet resistor body which includes a plurality of resistor body regions and has a front surface and a mounting surface which face in opposite directions; forming a plurality of grooves for resistance adjustment for each of the resistor body regions, the plurality of grooves being formed in front surfaces of the plurality of resistor body regions and not penetrating through the resistor body region; forming a protective film body covering a portion of the plurality of resistor body regions in the front surface of the sheet resistor body; forming a conductive layer in an exposed portion of the plurality of resistor body regions, which is not covered by the protective film body, in the front surface of the sheet resistor body; and dividing the sheet resistor body into segments for the resistor body regions to form a pair of inner electrodes, which are in electrical conduction with the resistor body regions, on both sides of each of the resistor body regions with the resistor body regions sandwiched between the inner electrodes.

In some embodiments, the act of forming a plurality of grooves includes forming a trimming groove for each of the resistor body regions, the trimming groove penetrating through the resistor body region.

In some embodiments, the act of forming a plurality of grooves includes forming the plurality of grooves by means of a laser trimming device.

In some embodiments, the act of forming a plurality of grooves includes forming the plurality of grooves for each of a plurality of sections set in each of the resistor body regions.

In some embodiments, the act of forming a plurality of grooves includes forming the plurality of grooves in an order from a section located in an outer side of the resistor body region toward a section located in an inner side of the resistor body region.

In some embodiments, the act of forming a plurality of grooves includes forming the plurality of grooves alternately in an order of a section located between the center of the resistor body region and one of the pair of inner electrodes and a section located between the center of the resistor body region and the other of the pair of inner electrodes.

In some embodiments, the act of forming a conductive layer includes forming the conductive layer by means of deposition or printing.

In some embodiments, the deposition is a sputtering.

In some embodiments, the method further includes forming an intermediate electrode covering the pair of inner electrodes and an outer electrode covering the intermediate electrode for each of the segments.

In some embodiments, the act of forming an intermediate electrode and an outer electrode includes forming the intermediate electrode and the outer electrode by means of plating.

In some embodiments, the method further includes bonding a sheet substrate to the mounting surface of the sheet resistor body.

In some embodiments, the act of bonding a sheet substrate includes bonding the sheet substrate by applying an adhesive made of an epoxy resin to the mounting surface of the sheet resistor body or by disposing an adhesive sheet made of a glass epoxy resin on the mounting surface of the sheet resistor body.

Those and other features and merits of the present disclosure will be more apparent from the following detailed description in conjunction with the accompanying drawings.

DETAILED DESCRIPTION

Some embodiments of a chip resistor according to the present disclosure will now be described in detail with reference to the drawings.

First Embodiment

Figure 1:
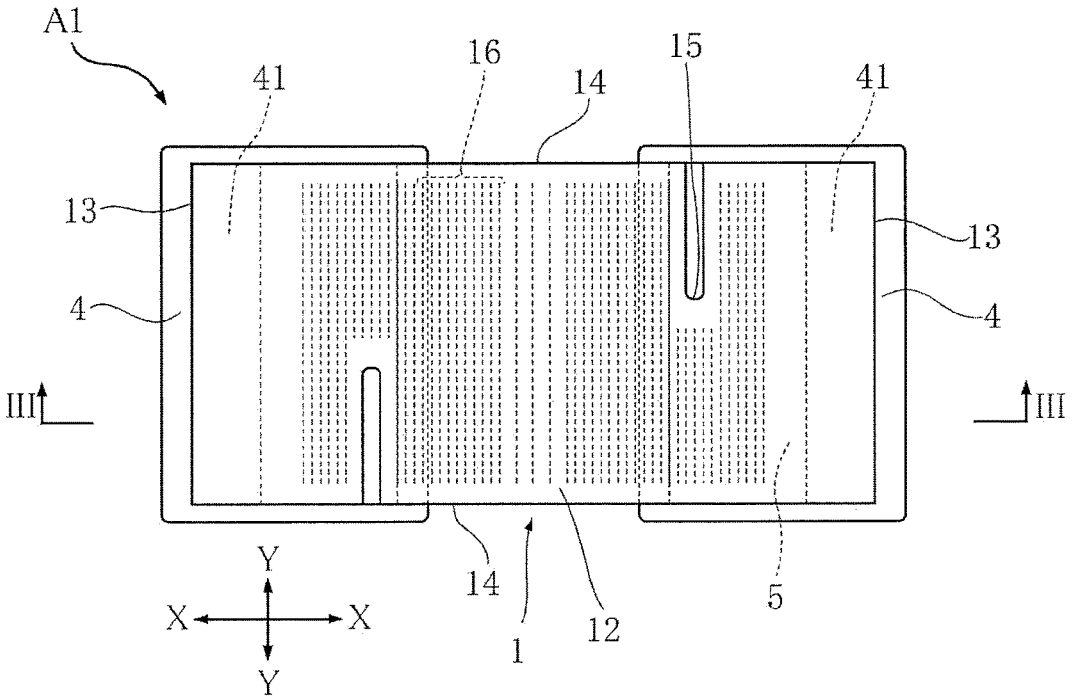
FIG. 1 is a plan view showing a chip resistor according to a first embodiment of the present disclosure.
Figure 2:
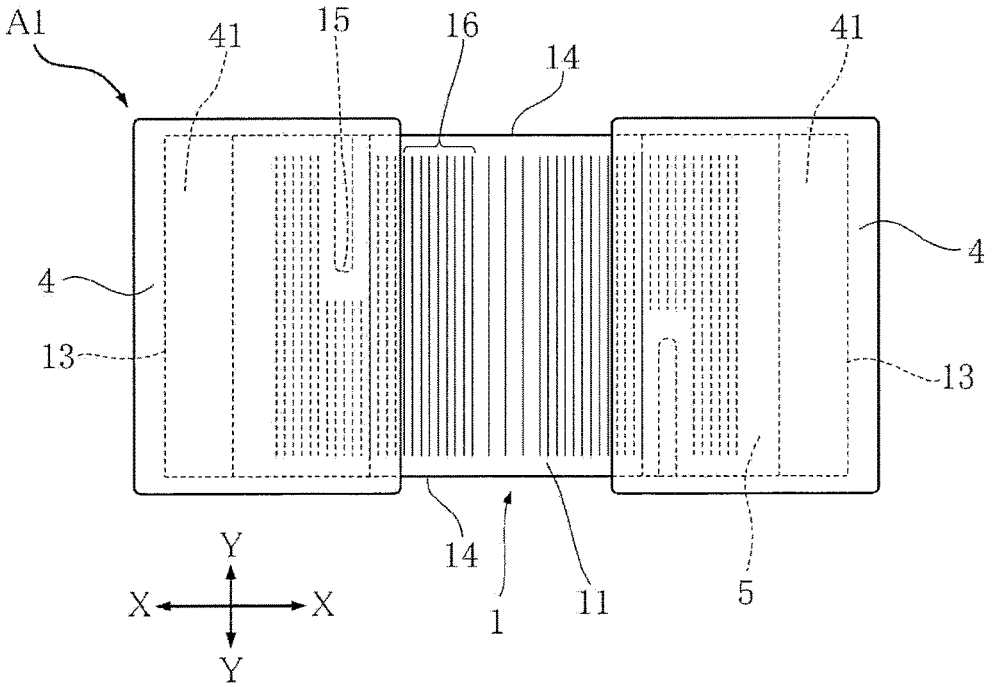
FIG. 2 is a bottom view showing the chip resistor of FIG. 1.
Figure 3:
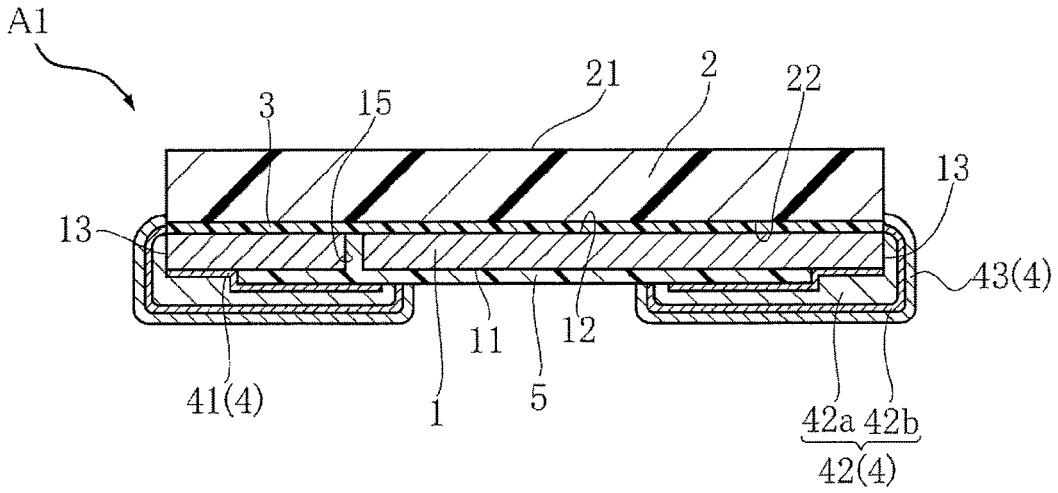
FIG. 3 is a sectional view taken along line in FIG. 1.
Figure 4:
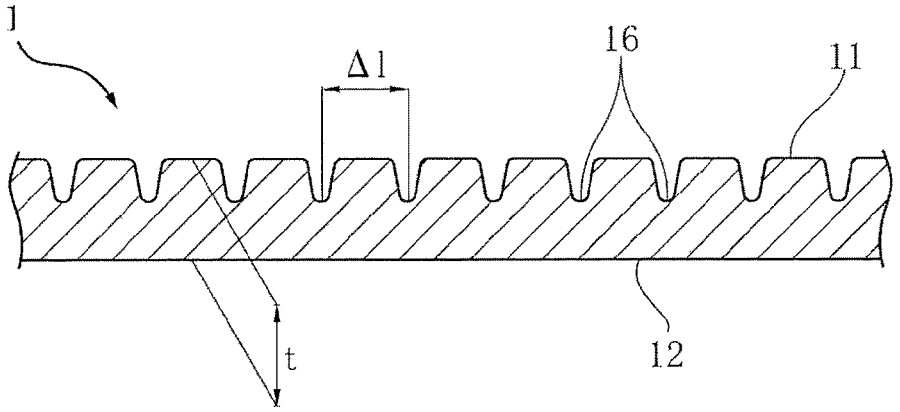
FIG. 4 is a main part-enlarged sectional view schematically showing a resistor body of the chip resistor of FIG. 1.

A chip resistor A1 according to a first embodiment of the present disclosure will be described below with reference to FIGS. 1 to 4. FIG. 1 is a plan view showing the chip resistor A1. FIG. 2 is a bottom view showing the chip resistor A1. FIG. 3 is a sectional view taken along line III-III in FIG. 1. FIG. 4 is a main part-enlarged sectional view schematically showing a resistor body 1 (which will be described later) of the chip resistor A1. For the purpose of easy understanding, a substrate 2 and an adhesion layer 3, which will be described later, are not shown in FIG. 1. In addition, for the purpose of easy understanding, FIG. 2 shows a protective film 5, which will be described layer, in a "see-through" manner.

The chip resistor A1 shown in these figures is of such a type that it is to be surface-mounted on a circuit board of various kinds of electronic devices. In this embodiment, the chip resistor A1 includes the resistor body 1, the substrate 2, the adhesion layer 3, an electrode 4 and the protective film 5. In this embodiment, the chip resistor A1 has a rectangular shape when viewed from top.

The resistor body 1 is an element acting to limit or detect a current. In this embodiment, the thickness t of the resistor body 1 shown in FIG. 4 is 50 to 150 μm. In this embodiment, the resistor body 1 has a rectangular shape with a long side in the direction X shown in FIGS. 1 and 2 when viewed from the top. The resistor body 1 is made of, for example, an alloy containing Cu, Mn and Ni (manganin), zeranin, a Cu—Ni alloy, a Ni—Cr alloy or a Fe—Cr alloy. The resistor body 1 has a front surface 11, a mounting surface 12, a first side 13, a second side 14, a trimming groove 15 and a plurality of grooves 16.

The front surface 11 corresponds to the bottom of the resistor body 1 shown in FIG. 3 and is covered by the electrode 4 and the protective film 5. The mounting surface 12 corresponds to the top of the resistor body 1 shown in FIG. 3 and is used when the resistor body 1 is mounted on the substrate 2. The front surface 11 and the mounting surface 12 face in opposite directions. The mounting surface 12 also faces the substrate 2. The first side 13 is a pair of surfaces which are perpendicular to the front surface 11 and the mounting surface 12 and face the long side direction (the direction X shown in FIGS. 1 and 2) of the resistor body 1. The second side 14 is a pair of surfaces which are perpendicular to the front surface 11 and the mounting surface 12 and face the short side direction (the direction Y shown in FIGS. 1 and 2) of the resistor body 1. The first side 13 and the second side 14 are located between the front surface 11 and the mounting surface 12. In addition, the first side 13 and the second side 14 are perpendicular to each other.

The trimming groove 15 penetrates through the resistor body 1 in its thickness direction. An opening is formed by the trimming groove 15 in the side of the resistor body 1 in its long side direction. In this embodiment, two trimming grooves 15 are formed in the resistor body 1.

The plurality of grooves 16 is formed in the front surface 11 of the resistor body 1 and does not penetrate through the resistor body 1 in its thickness direction. The width of each of the plurality of grooves 16 is smaller than the width of the trimming groove 15. In this embodiment, the direction of the plurality of grooves 16 is a direction (the direction Y shown in FIGS. 1 and 2) perpendicular to a direction (the direction X shown in FIGS. 1 and 2) of current flowing through the resistor body 1. In this embodiment, the interval A1 between the plurality of grooves 16 is 50 to 100 μm.

The substrate 2 is a member on which the resistor body 1 is mounted. When the substrate 2 is integrated with the resistor body 1 via the adhesive layer 3, the substrate 2 acts to reinforce the chip resistor A1 against an external force and protect the resistor body 1. In this embodiment, the substrate 2 is an electrical insulator. In addition, the substrate 2 may be made of a material having high thermal conductivity in order to facilitate radiation of heat generated from the resistor body 1 to the outside when the chip resistor A1 is used. Therefore, in this embodiment, the substrate 2 is made of, for example, alumina ($Al_2O_3$). The substrate 2 has a main surface 21 and a mounting surface 22. In this embodiment, the substrate 2 has the same rectangular shape as the resistor body 1 when viewed from top.

The main surface 21 corresponds to the top of the substrate 2 shown in FIG. 3 and is exposed to the outside. The mounting surface 22 corresponds to the bottom of the substrate 2 shown in FIG. 3 and is used when the resistor body 1 is mounted on the substrate 2. The main surface 21 and the mounting surface 22 face in opposite directions. The mounting surface 22 also faces the resistor body 1. Therefore, the resistor body 1 is mounted on the substrate 2 under a state where the mounting surface 12 of the resistor body 1 and the mounting surface 22 of the substrate 2 face each other.

The adhesive layer 3 is interposed between the mounting surface 12 of the resistor body 1 and the mounting surface 22 of the substrate 2 and is a member made of an adhesive for mounting the resistor body 1 on the substrate 2. The adhesive layer 3 is an electrical insulator. In this embodiment, the adhesive layer 3 is made of, for example, an epoxy resin or a glass epoxy resin which is a prepreg obtained by impregnating a fiberglass cloth with an epoxy resin. Although it is shown in this embodiment that the adhesive layer 3 covers the entire mounting surface 22 of the substrate 2, the adhesive layer 3 may be disposed to cover a portion of the mounting surface 22.

The electrode 4 is a pair of members which make electrical conduction with the resistor body 1 and are separated from each other in order to interconnect the chip resistor A1 and wiring patterns of circuit boards of various kinds of electronic devices. The electrode 4 is disposed at both sides of the resistor body 1 with the resistor body 1 sandwiched therebetween in the direction X shown in FIGS. 1 and 2. The electrode 4 includes an inner electrode 41, an intermediate electrode 42 and an outer electrode 43.

The inner electrode 41 is a pair of portions which are electrically connected to the resistor body 1, partially cover the protective film 5, and are separated from each other. In this embodiment, the inner electrode 41 is made of, for example, a Ni—Cr alloy. The inner electrode 41 covers a portion of the front surface 11 of the resistor body 1 and makes electrical conduction with the resistor body 1.

The intermediate electrode 42 is a pair of portions which cover the inner electrode 41 and are separated from each other. In this embodiment, the intermediate electrode 42 is composed of a first intermediate electrode **42*a* and a second intermediate electrode 42*b*. The first intermediate electrode 42*a* is a pair of portions which cover the inner electrode 41, the first side 13 of the resistor body 1 and a portion of the second side 14 of the resistor body 1 and are separated from each other. In this embodiment, the first intermediate electrode 42*a* is formed of, for example, a Cu plating layer. The second intermediate electrode 42*b* is a pair of portions which cover the first intermediate electrode 42*a* and are separated from each other. In this embodiment, the second intermediate electrode 42*b* is formed of, for example, a Ni plating layer. The second intermediate electrode 42*b* acts to protect the electrode 4** from heat and shock.

The outer electrode 43 is a pair of portions which cover the intermediate electrode 42 and are separated from each other. More specifically, the outer electrode 43 covers the second intermediate electrode **42*b* of the intermediate electrode 42. In this embodiment, the outer electrode 43 is formed of, for example, a Sn plating layer. When solder is adhered to and integrated with the outer electrode 43, the chip resistor A1 and wiring patterns of circuit boards of various kinds of electronic devices are interconnected. In this embodiment, since the second intermediate electrode 42*b* is formed of the Ni plating layer, it is difficult to directly adhere solder to the second intermediate electrode 42*b*. Therefore, it is necessary to provide the outer electrode 43** formed of the Sn plating layer.

The protective film 5 is a member covering a portion of the front surface 11 of the resistor body 1 and acting to protect the resistor body 1 from the outside. As shown in FIG. 3, a portion of the protective film 5 is interposed between the front surface 11 of the resistor body 1 and the inner electrode 41. The protective film 5 is an electrical insulator to prevent the resistance of the resistor body 1 from being varied due to an effect from the outside. In addition, in this embodiment, the protective film 5 is made of a thermosetting resin since the protective film 5 is greatly affected by heat generated from the resistor body 1 when the chip resistor A1 is used. Further, in order to facilitate radiation of the heat to the outside, it is preferable that the protective film 5 is made of a material having relatively high thermal conductivity. Therefore, in this embodiment, the protective film 5 is made of, for example, a polyimide resin.

Figure 13:
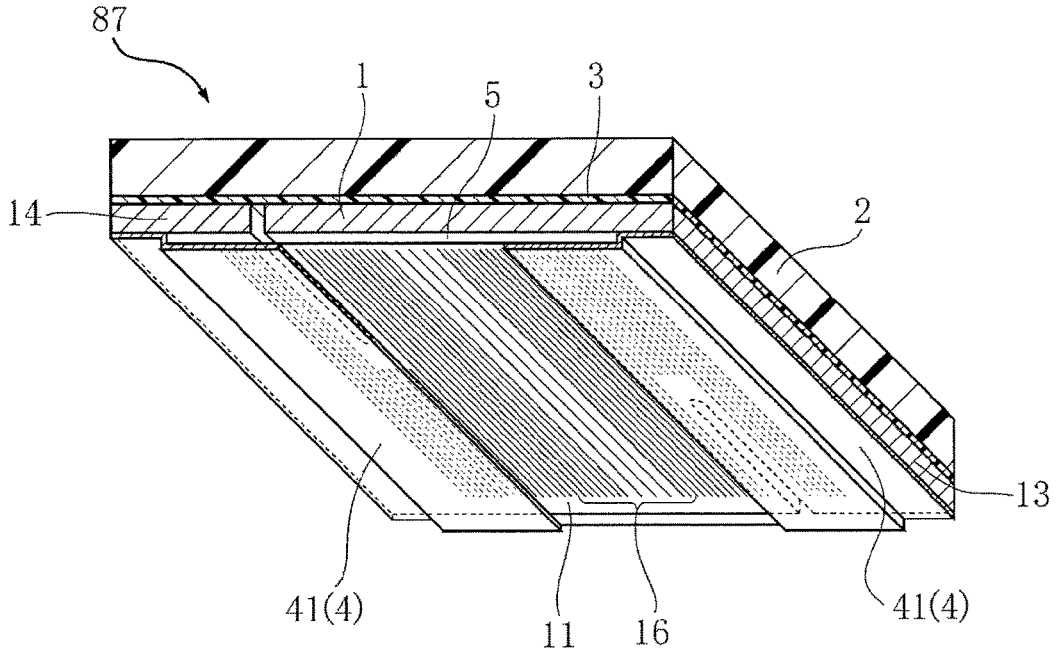
FIG. 13 is a perspective view showing a process according to the method for manufacturing the chip resistor of FIG. 1.
Figure 14:
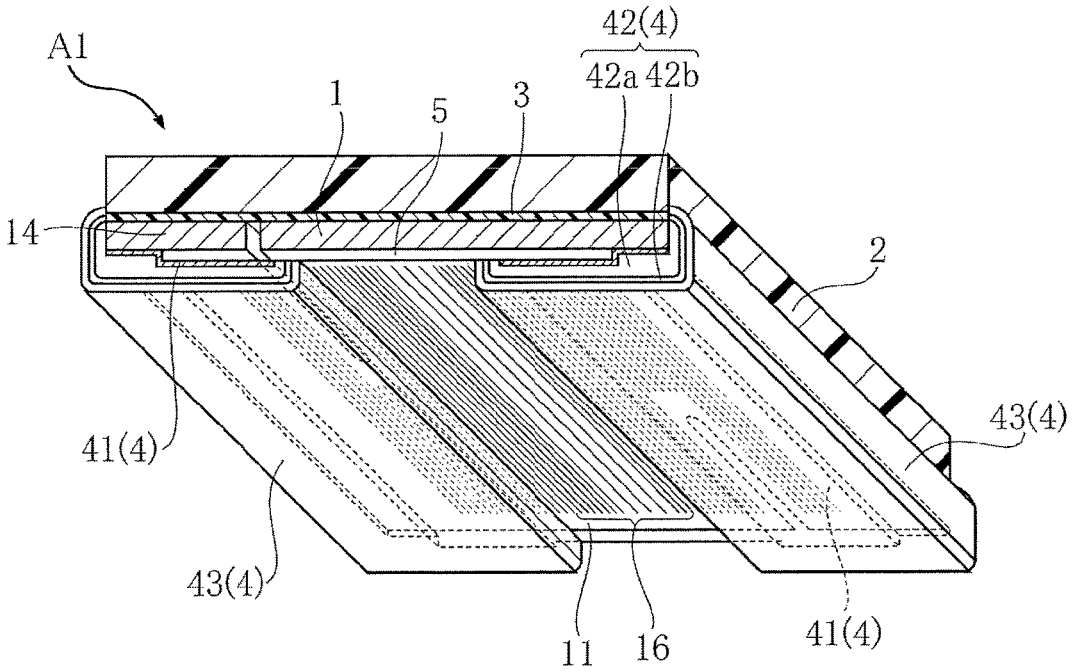
FIG. 14 is a perspective view showing a process according to the method for manufacturing the chip resistor of FIG. 1.

Next, a method for manufacturing the chip resistor A1 will be described with reference to FIGS. 5 to 14. FIGS. 5, 7, 11 and 12 are plan views showing a process according to a method for manufacturing the chip resistor A1. FIG. 8 is a plan view showing a method for manufacturing a resistor body region 811 of a sheet resistor body 81 (corresponding to the resistor body 1 of the chip resistor A1) to be described later. FIGS. 9A to 9H are plan views showing steps in the method for manufacturing the resistor body region 811 of FIG. 8. FIG. 10 is a main part-enlarged sectional view showing a state where the chip resistor A1 is manufactured. FIGS. 6, 13 and 14 are perspective views showing a process according to the method for manufacturing the chip resistor A1. For the purpose of easy understanding, FIGS. 13 and 14 show a protective film 5 in a "see-through" manner. Moreover, for the purpose of easy understanding, FIG. 14 shows a section of the electrode 4 along the second side 14 of the resistor body 1.

Figure 5:
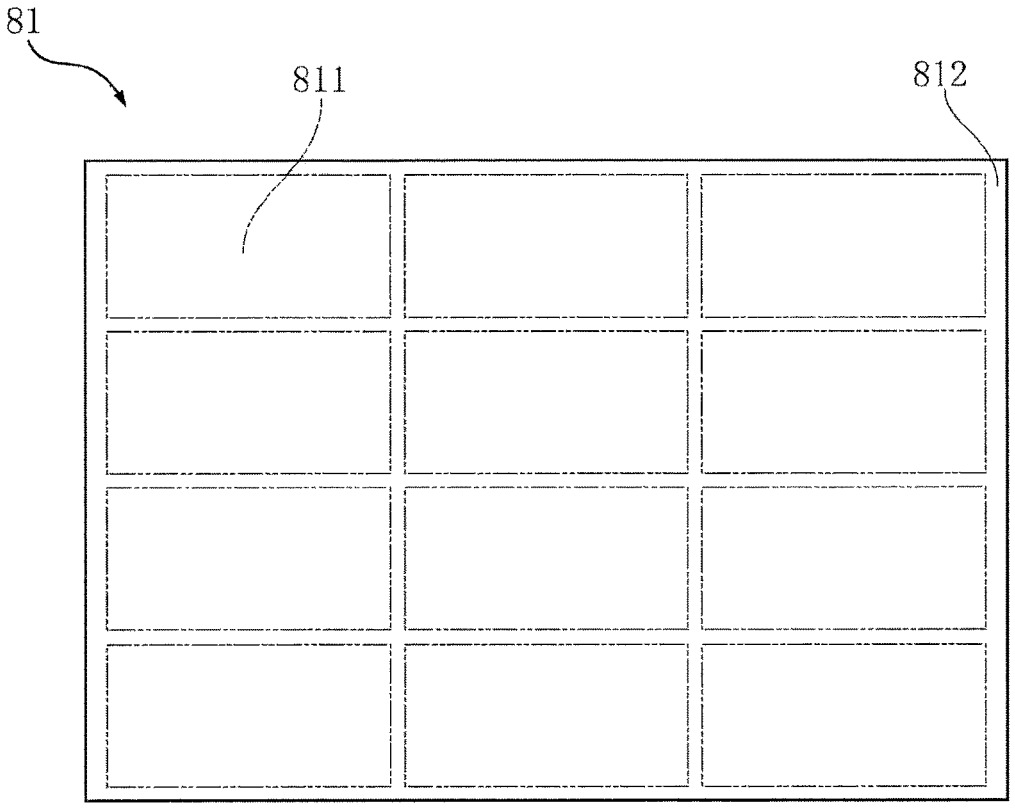
FIG. 5 is a plan view showing a process according to a method for manufacturing the chip resistor of FIG. 1.
Figure 6:
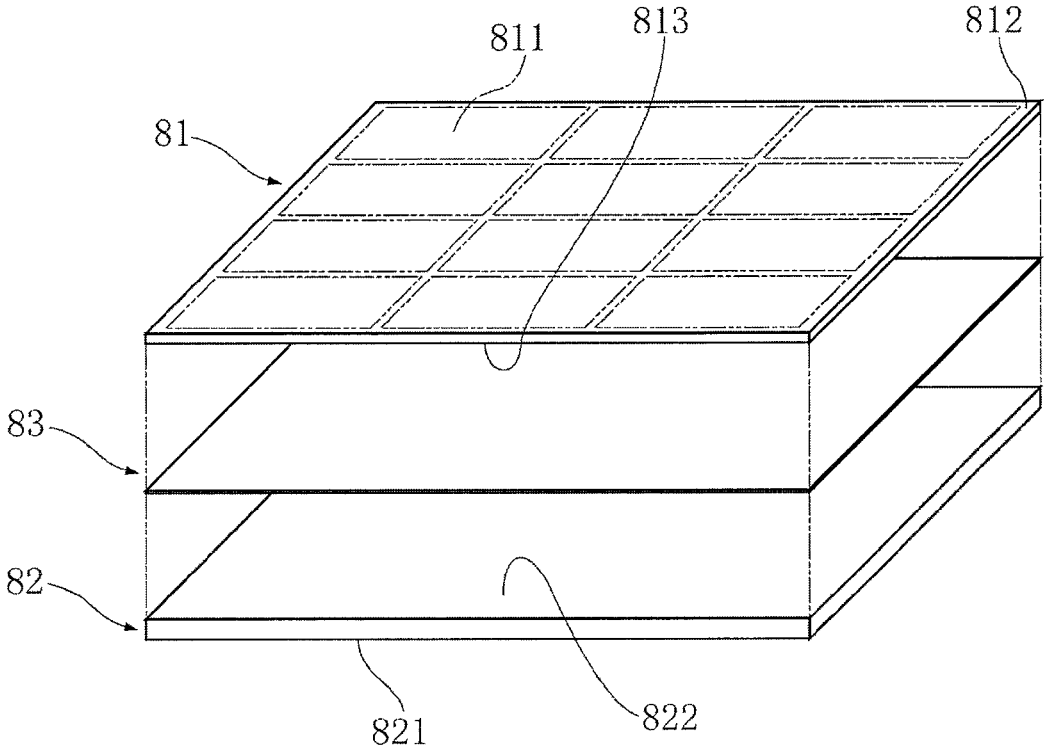
FIG. 6 is a perspective view showing a process according to the method for manufacturing the chip resistor of FIG. 1.

First, as shown in FIG. 5, the sheet resistor body 81 made of manganin, zeranin or a Cu—Ni alloy is prepared. The sheet resistor body 81 is a set of plural resistor body regions 811. Each of the resistor body regions 811 has a rectangular shape surrounded by a two-dot chain line shown in FIG. 5 when viewed from top. This region corresponds to a region where the resistor body 1 of the chip resistor A1 is formed. The sheet resistor body 81 has a front surface 812 and a mounting surface 813. The front surface 812 and the mounting surface 813 face in opposite directions. FIG. 5 shows the front surface 812 of the sheet resistor body 81.

Next, as shown in FIG. 6, a sheet substrate 82 is bonded to the mounting surface 813 of the sheet resistor body 81. The sheet substrate 82 has a main surface 821 and a mounting surface 822. The main surface 821 and the mounting surface 822 face in opposite directions. The sheet substrate 82 is made of alumina. In this embodiment, with an adhesive sheet 83 made of a glass epoxy resin sandwiched between the sheet resistor body 81 and the sheet substrate 82, the sheet substrate 82 is bonded by means of a high pressure vacuum press. The adhesive sheet 83 is sandwiched in a state where the mounting surface 813 of the sheet resistor body 81 and the mounting surface 822 of the sheet substrate 82 face each other. Alternatively, the sheet substrate 82 may be bonded by using a method of applying an adhesive made of an epoxy resin having fluidity, instead of the adhesive sheet 83, to the mounting surface 822 of the sheet substrate 82. In this case, the adhesive may be applied so as to partially cover each of the plurality of resistor body regions 811 in the mounting surface 813 of the sheet resistor body 81.

Figure 7:
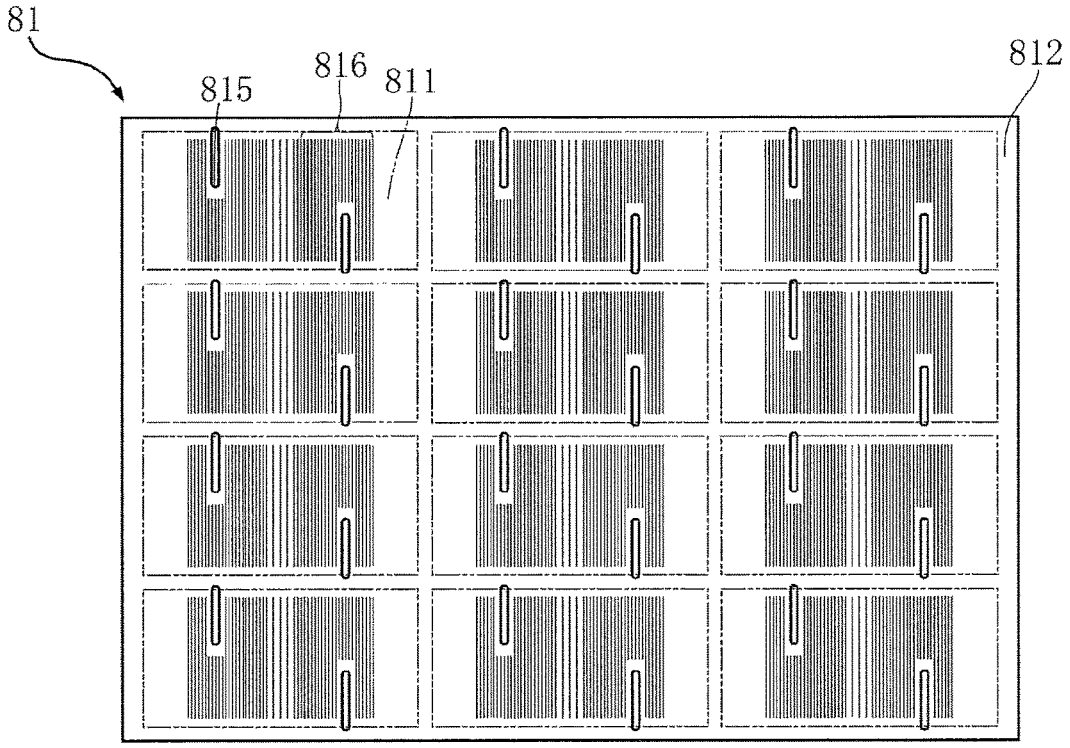
FIG. 7 is a plan view showing a process according to the method for manufacturing the chip resistor of FIG. 1.
Figure 8:
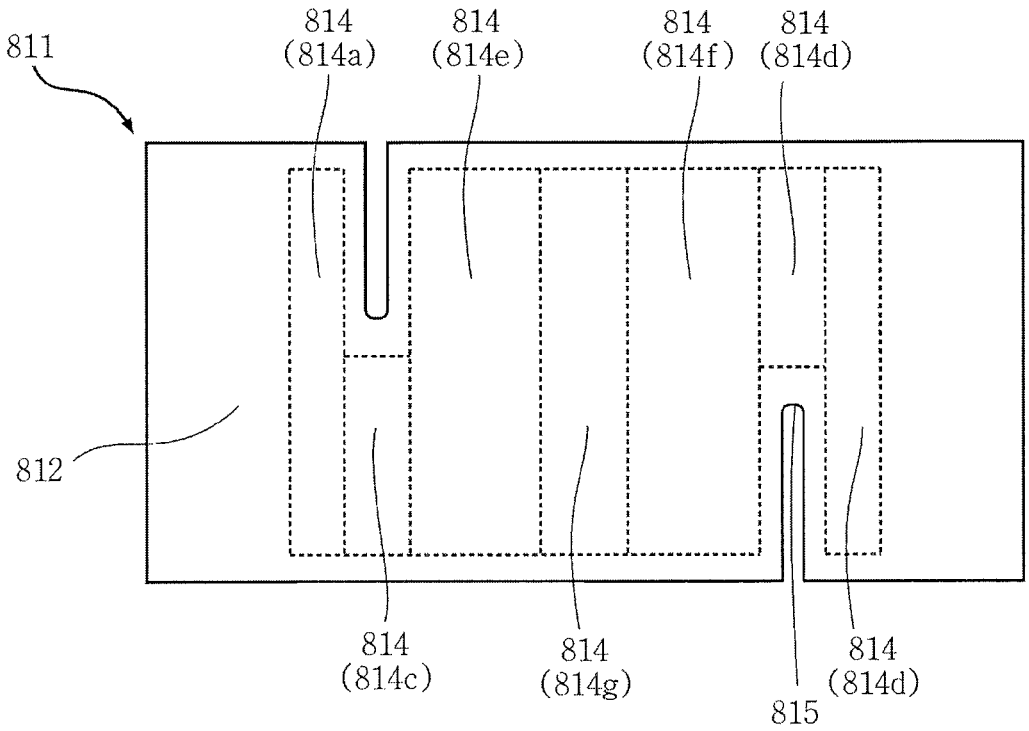
FIG. 8 is a plan view showing a method for manufacturing a resistor body region (the resistor body of the chip resistor of FIG. 1).

Next, as shown in FIG. 7, two trimming grooves 815 are formed in each of the plurality of resistor body regions 811 in such a manner that the two trimming grooves 815 penetrate through the corresponding one resistor body region 811. After the trimming grooves 815 are formed, a plurality of grooves for resistance adjustment, which does not penetrate through the resistor body regions 811, is formed in the front surfaces 812 of the plurality of resistor body regions 811. The trimming grooves 815 and the plurality of grooves 816 correspond respectively to the trimming grooves 15 and the plurality of grooves 16 of the above-described resistor body 1. In this embodiment, the trimming grooves 815 and the plurality of grooves 816 are formed by means of a laser trimming device (not shown). Each of the trimming grooves 815 is formed to be perpendicular to a direction of current flowing through the corresponding resistor body region 811 from one of the sides of the resistor body region 811 toward the other thereof in the long side direction. In this case, the resistance of each resistor body region 811 is set to be about 85% or more of target resistance. Therefore, the number of trimming grooves 815 required to set the resistance of the resistor body region 811 to be about 85% or more of target resistance may be one or three or more. If the resistance of the resistor body region 811 is already close to the target resistance, no trimming groove may be formed.

After forming the trimming grooves 815 in the plurality of resistor body regions 811, the plurality of grooves 816 is subsequently formed in the front surfaces 812 of the plurality of resistor body regions 811. Here, the plurality of grooves 816 is formed for each of a plurality of sections 814 (regions surrounded by broken lines shown in FIG. 8) set in the front surface 812 of the resistor body region 811 shown in FIG. 8. In this case, the plurality of grooves 816 is formed in the order of sections 814*a*, 814*b*, 814*c*, . . . , 814*f* and 814*g*. Therefore, the plurality of grooves 816 is formed in the order from a section 814 located in the outer side of the resistor body region 811 toward a section 814 located in the inner side of the resistor body region 811. In addition, the plurality of grooves 816 is alternately formed in the order of a section 814 located between the center of the resistor body region 811 and one of a pair of inner electrodes 41 (formed by a conductive layer 841 to be described later) and a section 814 located between the center of the resistor body region 811 and the other of the pair of inner electrodes 41.

Figure 9A:
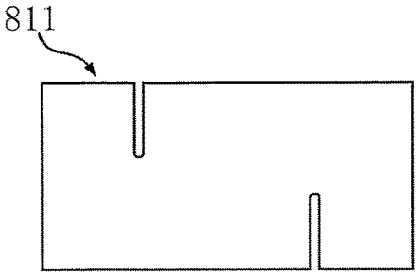
FIGS. 9A to 9H are plan views showing steps in the method for manufacturing the resistor body region of FIG. 8.
Figure 9B:
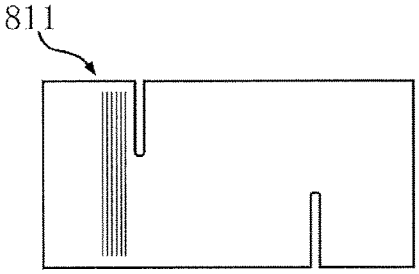
Figure 9C:
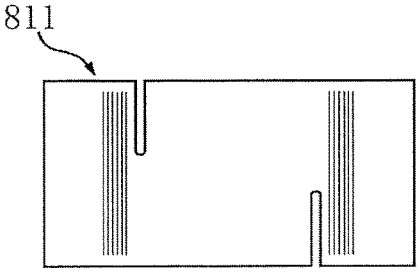
Figure 9D:
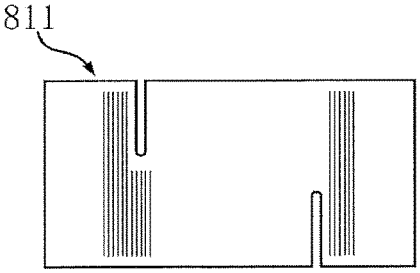
Figure 9E:
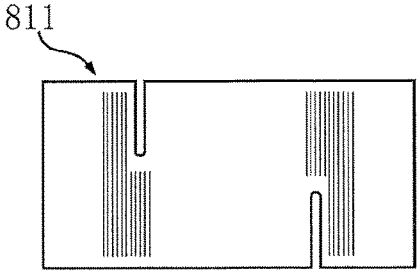
Figure 9F:
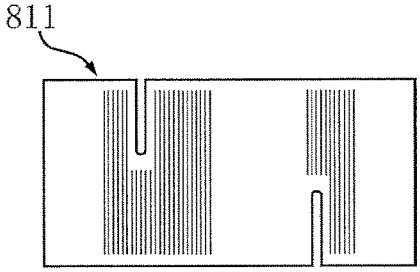
Figure 9G:
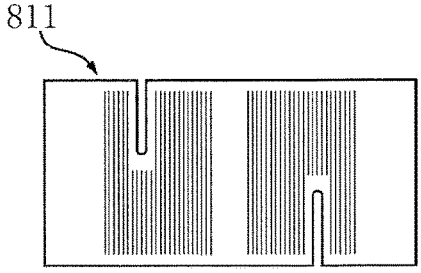
Figure 9H:
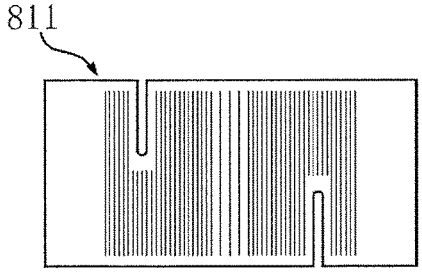
Figure 10:
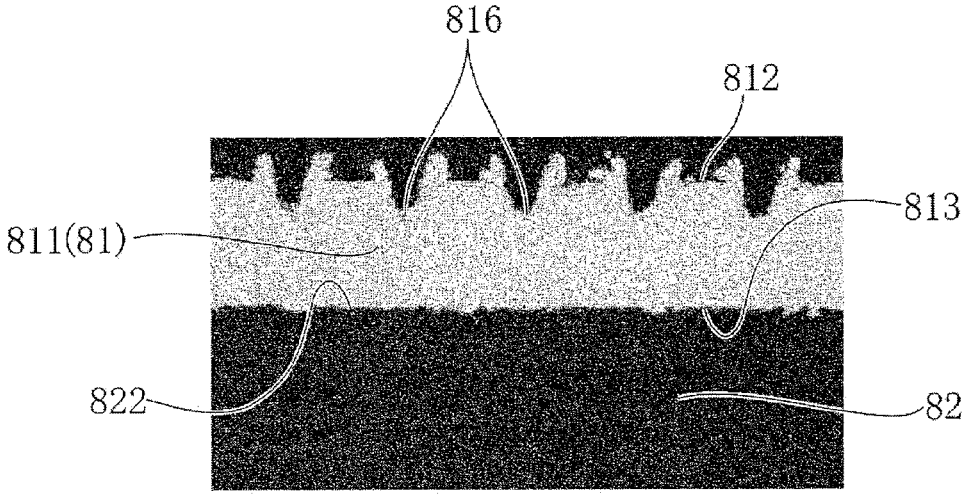
FIG. 10 is a main part-enlarged sectional view showing a state where the chip resistor of FIG. 1 is manufactured.

FIGS. 9A to 9H show a detailed process of forming the plurality of grooves 816. FIG. 9A shows that trimming grooves 815 are formed in a resistor body region 811. FIG. 9B shows that a plurality of grooves 816 is formed in the section 814*a* of the front surface 812 of the resistor body region 811. FIG. 9C shows that a plurality of grooves 816 is formed in the section 814*b* of the front surface 812 of the resistor body region 811. FIG. 9D shows that a plurality of grooves 816 is formed in the section 814*c* of the front surface 812 of the resistor body region 811. A plurality of grooves 816 is formed as shown in the order of FIGS. 9E, 9F and 9G. FIG. 9H shows that a plurality of grooves 816 is formed in the final section 814*g* of the front surface 812 of the resistor body region 811.

The plurality of grooves 816 is formed under a state where a probe (not shown) for resistance measurement is in contact with both ends of the resistor body region 811 in the long side direction. In this embodiment, the plurality of grooves 816 is formed by recognizing an image of each section 814 and then irradiating the section 814 with a laser beam emitted from the laser trimming device. Therefore, each section 814 is correctly irradiated with the laser. The wavelength of the laser beam with which the section 814 is irradiated may be as short as possible (for example, less than 1 μm). The power of the laser beam may be 0.7 W to 1.0 W so as to prevent the laser beam from penetrating through the resistor body region 811. In this case, if a rate of increase in the resistance of the resistor body region 811 is relatively low, the plurality of grooves 816 is formed by irradiating the section 814 with the laser beam several times to trace the same position. In addition, in this embodiment, the plurality of grooves 816 is formed at equal intervals in the sections 814*a* to 814*f* shown in FIG. 8 and is perpendicular to the direction of current flowing through the resistor body region 811. The section 814*g* located in the center of the resistor body region 811 as shown in FIG. 8 is a section for final resistance adjustment. The process of forming the plurality of grooves 816 is terminated at the point of time when the resistance of the resistor body region 811 in the section 814*g* reaches the target resistance.

FIG. 10 is a main part-enlarged sectional view showing a state of manufacture of the chip resistor A1 after indeed forming the plurality of grooves 816. In this case, the material of the resistor body region 811 is manganin. Minute protrusions (burrs) are formed on the front surface 812 of the resistor body region 811 (the top surface of the resistor body region 811 shown in FIG. 10) along the plurality of grooves 816.

Figure 11:
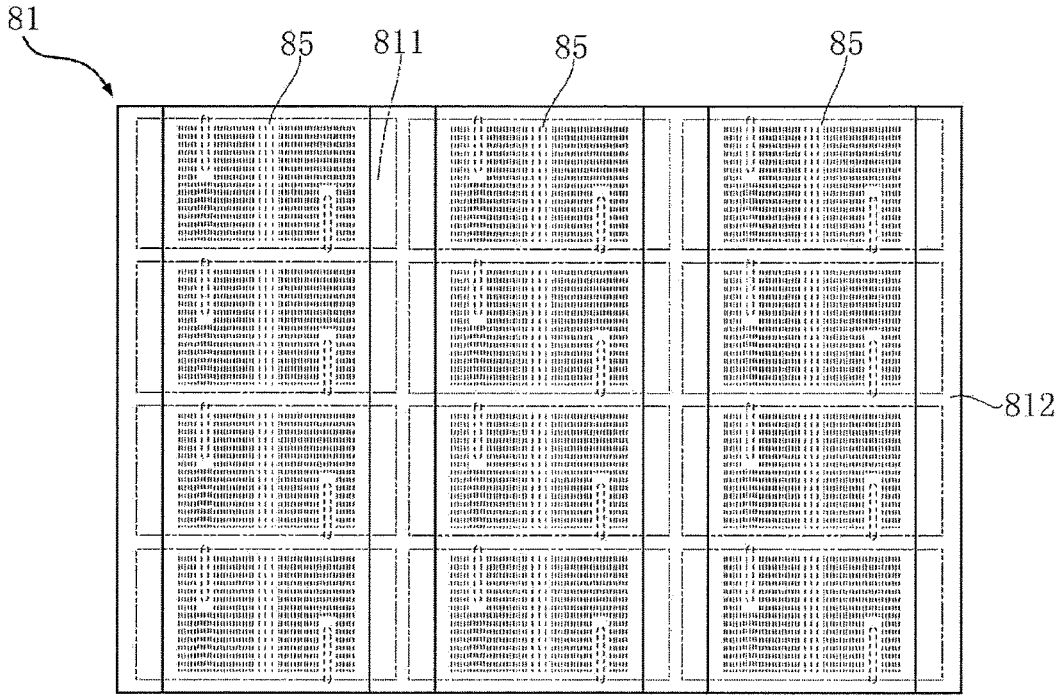
FIG. 11 is a plan view showing a process according to the method for manufacturing the chip resistor of FIG. 1.

Next, as shown in FIG. 11, a protective film body 85 covering a plurality of resistor body regions 811 is formed on the front surface 812 of the sheet resistor body 81. In this case, both ends of each of the resistor body regions 811 in the long side direction are exposed. In this embodiment, the protective film body 85 is formed in a multi-strip shape extending along the short side of the resistor body region 811 across the long side of the resistor body region 811. Here, the protective film body 85 may be formed to have a state of being separated for each of the resistor body regions 811. In addition, in this embodiment, the protective film body 85 is formed by printing a polyimide resin having fluidity by means of silk screening and curing the polyimide resin. Instead of printing, coating or the like may be used.

Figure 12:
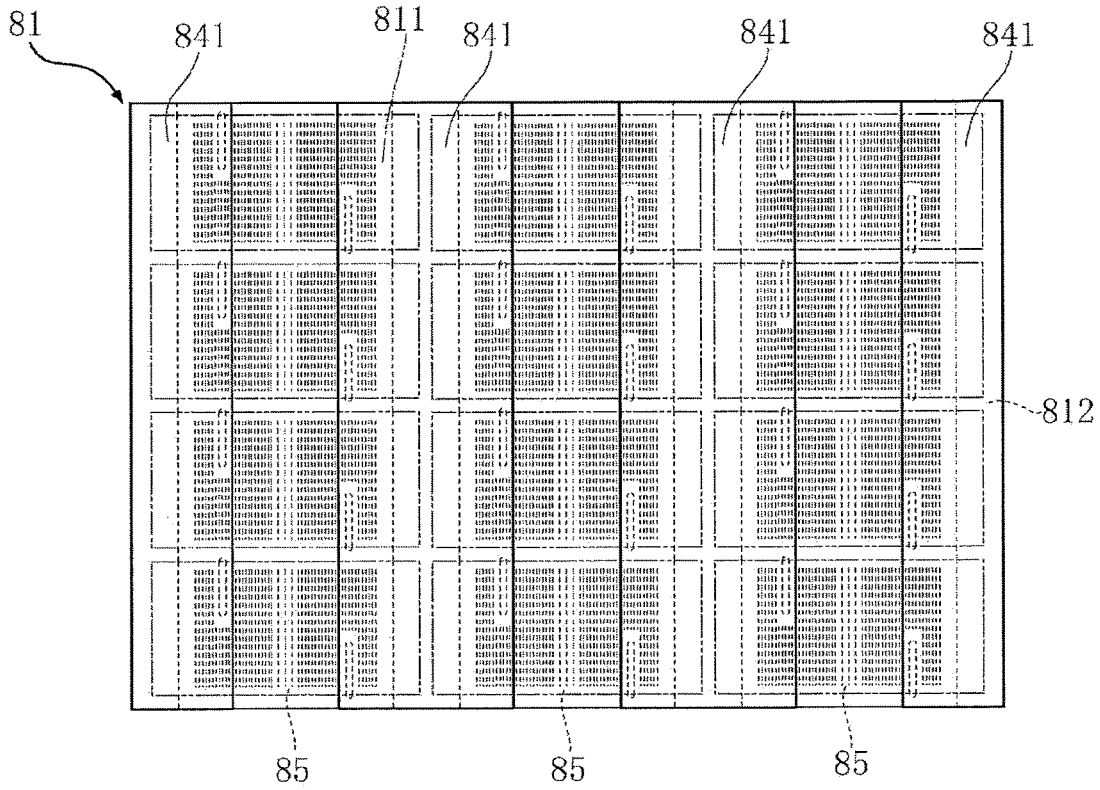
FIG. 12 is a plan view showing a process according to the method for manufacturing the chip resistor of FIG. 1.

Next, as shown in FIG. 12, a conductive layer 841 is formed on the exposed portion of each of the plurality of resistor body regions 811, which is not covered by the protective film body 85, in the front surface 812 of the sheet resistor body 81. In this case, in addition to the exposed portion, a portion of the protective film body 85 is covered by the conductive layer 841. In this embodiment, the conductive layer 841 is formed in a multi-strip shape extending along the short side of the resistor body region 811 across the long side of the resistor body region 811. Here, like the above-described protective film body 85, the conductive layer 841 may be formed to have a state of being separated for each of the resistor body regions 811. The conductive layer 841 is formed by means of a depositing process or a printing process. In this embodiment, the conductive layer 841 is formed by depositing a Ni—Cr alloy by means of sputtering.

Next, as shown in FIG. 13, regions (the regions surrounded by the two-dot chain lines shown in FIG. 5) including the resistor body regions 811 of the sheet resistor body 81 are divided into a plurality of segments 87 by punching Δt this time, each of the resistor body regions 811 corresponds to the resistor body 1. When the sheet resistor body 81 is divided into the plurality of segments 87, the pair of inner electrodes 41 making electrical conduction with the resistor body region 811 is formed on both sides of the resistor body region 811 with the resistor body region 811 sandwiched therebetween. The pair of inner electrodes 41 corresponds to the above-described conductive layer 841. In addition, the substrate 2, the adhesive layer 3 and the protective film 5 correspond to the above-described sheet substrate 82, adhesive sheet 83 and protective film body 85, respectively.

Next, as shown in FIG. 14, the intermediate electrode 42 covering the pair of inner electrodes 41 and the outer electrode 43 covering the inter mediate electrodes 42 are formed in each of the segments 87. A process of forming the intermediate electrode 42 includes a process of forming the first intermediate electrode 42*a* covering the pair of inner electrode 41 and a process of forming the second intermediate electrode 42*b* covering the first intermediate electrode 42*a*. In this case, the first side 13 of the resistor body 1 and a portion of the second side 14 of the resistor body 1 are covered by the first intermediate electrode 42*a*. In this embodiment, the first intermediate electrode 42*a*, the second intermediate electrode 42*b* and the outer electrode 43 are formed by Cu-plating, Ni-plating and Sn-plating, respectively. The pair of electrodes 4 in electrical conduction with the resistor body 1 is formed by the corresponding process. The chip resistor A1 is manufactured through the above-described processes.

Next, the operation and effects of the chip resistor A1 will be described.

According to this embodiment, the plurality of grooves 16, which does not penetrate through the resistor body 1, unlike the trimming grooves 15, is formed in the front surface 11 of the resistor body 1 of the chip resistor A1. Since the laser trimming device used to form the plurality of grooves 16 recognizes an image of each of the plurality of sections 814 set in the front surface 812 (the front surface 11) of the resistor body region 811 (the resistor body 1) and then irradiates the sections 814 with a laser beam, it is possible to efficiently form the plurality of grooves 16 in the front surface 812 of the resistor body region 811 at equal intervals. Therefore, it is possible to adjust the target resistance for each of chip resistors A1 with high accuracy while utilizing the laser trimming device constituting an existing production facility.

When the direction of the plurality of grooves 16 is perpendicular to the direction of current flowing through the resistor body 1, a section having a narrower area than when the direction of the plurality of grooves 16 is the same as the direction of current flowing through the resistor body 1 is formed in the resistor body 1. This can prevent the rate of increase in the resistance of the resistor body 1 from being greatly reduced when the plurality of grooves 16 is formed. Therefore, it is possible to prevent reduction in efficiency of adjustment of the resistance of the chip resistor A1 due to the formation of the plurality of grooves 16.

In the process of forming the plurality of grooves 16, the plurality of grooves 16 is formed for each of sections 814 set in the front surface 812 of the resistor body region 811. In addition, the plurality of grooves 16 is formed in the order from a section 814 located in the outer side of the resistor body region 811 toward a section 814 located in the inner side of the resistor body region 811. Further, the plurality of grooves 16 is alternately formed in the order of a section 814 located between the center of the resistor body region 811 and one of a pair of inner electrodes 41 and a section 814 located between the center of the resistor body region 811 and the other of the pair of inner electrodes 41. When the plurality of grooves 16 is formed in this order, heat concentration in the resistor body region 811 due to the irradiation of the laser beam is reduced. Therefore, since the rate of increase in the resistance of the resistor body 1 due to a temperature drift caused when the plurality of grooves 16 is formed, it is possible to prevent the precision of resistance of the chip resistor A1 from being lowered.

Since the inner electrode 41 is configured to cover a portion of the protective film 5, it is possible to secure a wider surface area of the electrode 4. Therefore, in use of the chip resistor A1, it is possible to more easily radiate heat generated from the resistor body 1 to the outside.

FIGS. 15 to 20 show other embodiments of the present disclosure. Throughout these figures, the same or similar elements as the above-described chip resistor A1 are denoted by the same reference numerals and explanation of which will not be repeated.

Second Embodiment

Figure 15:
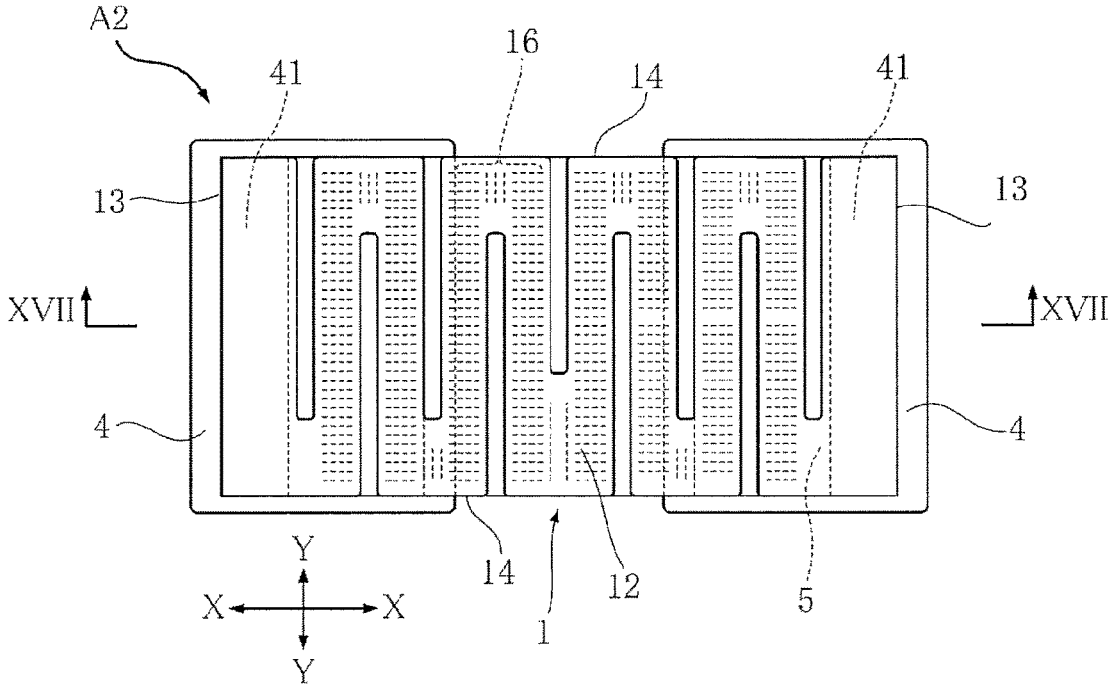
FIG. 15 is a plan view showing a chip resistor according to a second embodiment of the present disclosure.
Figure 16:
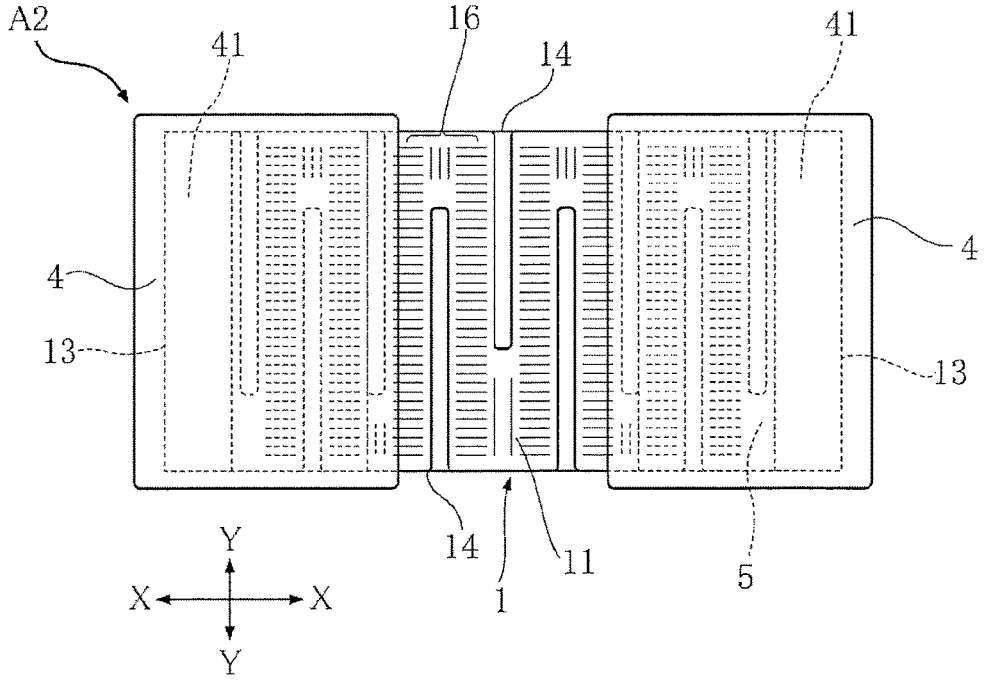
FIG. 16 is a bottom view showing the chip resistor of FIG. 15.
Figure 17:
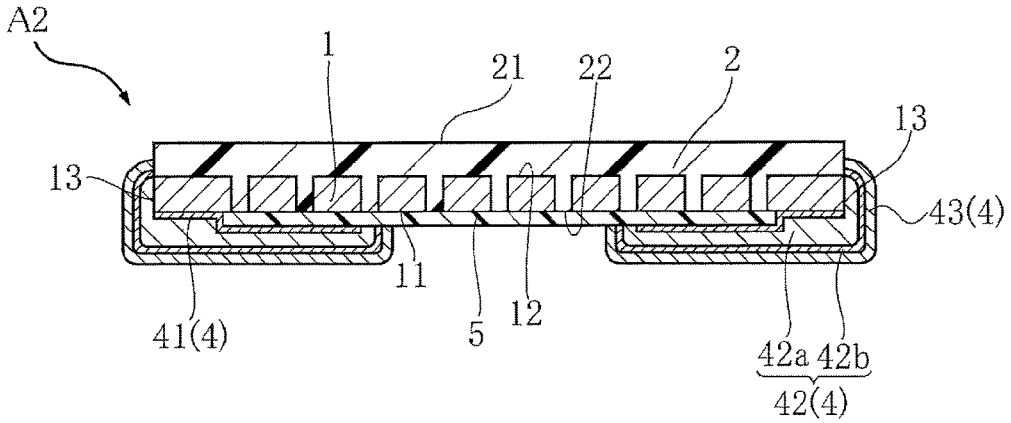
FIG. 17 is a sectional view taken along line XVII-XVII in FIG. 15.
Figure 18:
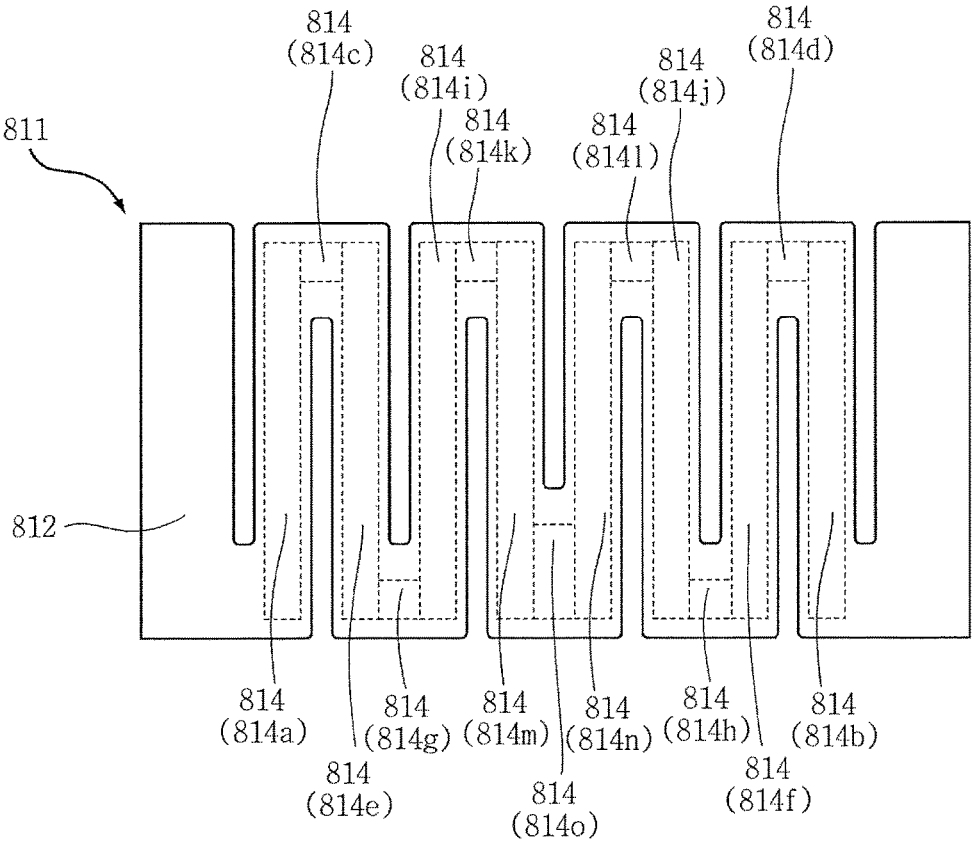
FIG. 18 is a plan view showing a method for manufacturing a resistor body region (the resistor body of the chip resistor of FIG. 15).

A chip resistor A2 according to a second embodiment of the present disclosure will be described below with reference to FIGS. 15 to 18. FIG. 15 is a plan view showing the chip resistor A2. FIG. 16 is a bottom view showing the chip resistor A2. FIG. 17 is a sectional view taken along line XVII-XVII in FIG. 15. FIG. 18 is a plan view showing a method for manufacturing a resistor body region 811 of a sheet resistor body 81 (a resistor body 1 of the chip resistor A2). For the purpose of easy understanding, a substrate 2 and an adhesion layer 3 are not shown in FIG. 15. In addition, for the purpose of easy understanding, FIG. 16 shows a protective film 5 in a "see-through" manner. In this embodiment, the chip resistor A2 has a rectangular shape when viewed from the top.

The chip resistor A2 of this embodiment is different from the above-described chip resistor A1 in terms of the material of the substrate 2 and the shape and arrangement of the resistor body 1 when viewed from the top. In this embodiment, the substrate 2 is made of a glass epoxy resin. By pressing the sheet resistor body 81 (the resistor body 1) except the adhesive sheet 83 shown in FIG. 6, and the sheet substrate 82 (the substrate 2) made of a glass epoxy resin by means of a high pressure vacuum press, the resistor body 1 is buried in the substrate 2, as shown in FIG. 17. This pressing is conducted in a state where the mounting surface 813 of the sheet resistor body 81 and the mounting surface 822 of the sheet substrate 82 face each other. This pressing makes it possible to mount the resistor body 1 on the mounting surface 22 of the substrate 2 so as to make the front surface 11 of the resistor body 1 substantially flush with the mounting surface 22 of the substrate 2, as shown in FIG. 17. Therefore, the chip resistor A2 does not include the adhesive layer 3.

In this embodiment, the resistor body 1 has a serpentine shape when viewed from the top. The resistor body 1 of this shape is formed by shape-machining by means of punching, lithography or the like.

In this embodiment, the plurality of grooves 816 is formed for each of a plurality of sections 814 (regions surrounded by broken lines shown in FIG. 18) set in the front surface 812 of the resistor body region 811 shown in FIG. 18. In this case, the plurality of grooves 816 is formed in the order of sections 814*a*, 814*b*, 814*c*, . . . , 814*n* and 814*o*. The section 814*o* located in the center of the resistor body region 811 is a section for final resistance adjustment. The process of forming the plurality of grooves 816 is terminated at the point of time when the resistance of the resistor body region 811 in the section 814*o* reaches the target resistance. In addition, depending on the rate of increase in the resistance of the resistor body region 811, the plurality of grooves 816 may not be formed in the sections 814*c*, 814*d*, 814*g*, 814*h*, 814*k* and 814*l*.

According to this embodiment, by adjusting the resistance of the resistor body 1 by the plurality of grooves 16, it is possible to adjust the target resistance for each of chip resistors A2 with high accuracy while utilizing an existing production facility. In addition, by mounting the resistor body 1 on the mounting surface 22 of the substrate 2 in the state where the resistor body 1 is buried in the substrate 2, it is possible to make the chip resistor A2 thinner than the chip resistor A1. Further, by making the resistor body 1 into a serpentine shape when viewed from the top, it is possible to increase the resistance of the chip resistor A2 over the resistance of the chip resistor A1. Therefore, it is possible to cope with higher power while achieving compactness of the chip resistor A2.

Third Embodiment

Figure 19:
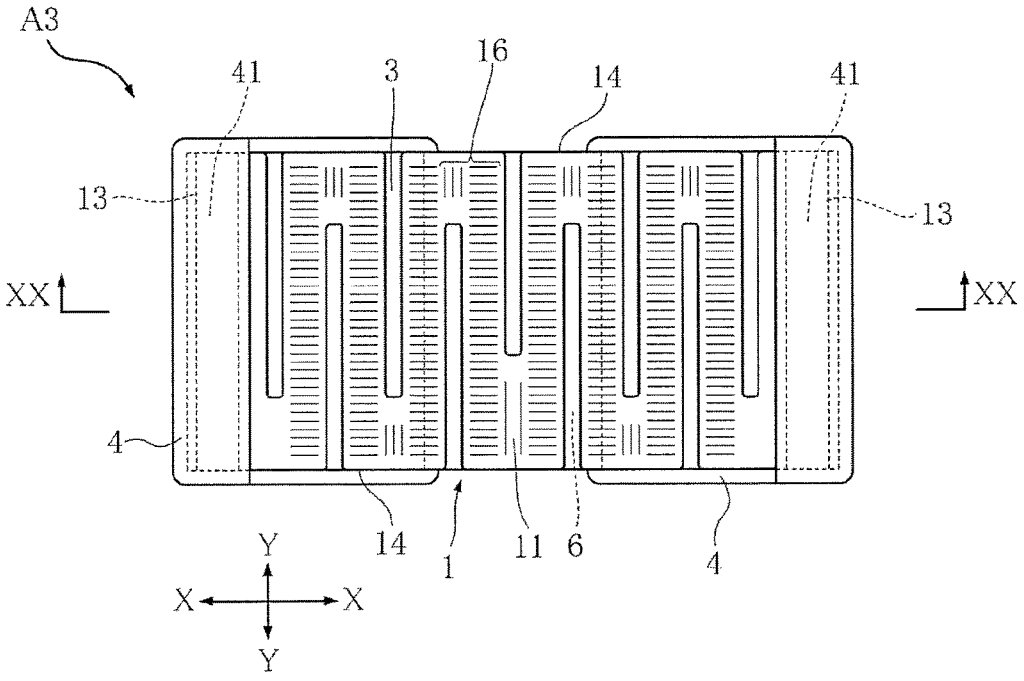
FIG. 19 is a plan view showing a chip resistor according to a third embodiment of the present disclosure.
Figure 20:
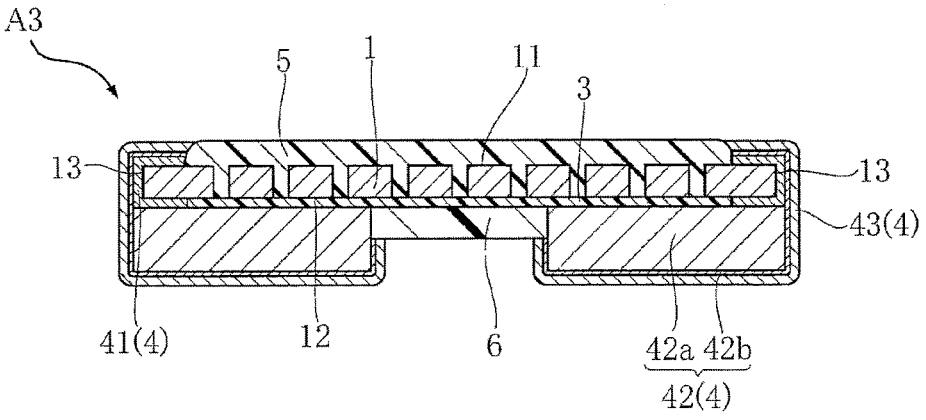
FIG. 20 is a sectional view taken along line XX-XX in FIG. 19.

A chip resistor A3 according to a third embodiment of the present disclosure will be described below with reference to FIGS. 19 and 20. FIG. 19 is a plan view showing the chip resistor A3. FIG. 20 is a sectional view taken along line XX-XX in FIG. 19. For the purpose of easy understanding, a protective film 5 is not shown in FIG. 19. In this embodiment, the chip resistor A3 has a rectangular shape when viewed from the top.

The chip resistor A3 of this embodiment is different from the above-described chip resistors A1 and A2 in terms of the arrangement of the resistor body 1, the adhesive layer 3 and the protective film 5 and the configuration of the electrode 4. The chip resistor A3 is further different from the above-described chip resistors A1 and A2 in that the chip resistor A3 is not provided with the substrate 2 but is provided with a heat conduction part 6.

In this embodiment, the front surface 11 of the resistor body 1 faces upward as shown in FIG. 20. A shape of the resistor body 1 when viewed from the top and a method for forming the plurality of grooves 16 are the same as those for the chip resistor A2. In addition, in this embodiment, the mounting surface 12 of the resistor body 1 and the first intermediate electrode 42*a* of the electrode 4 are arranged to face each other. The adhesive layer 3 is interposed between the mounting surface 12 of the resistor body 1 and the first intermediate electrode 42*a*. The front surface of the protective film 5 faces upward as shown in FIG. 20.

The inner electrode 41 is a pair of portions which are in electrical conduction with the resistor body 1 and are separated from each other. In this embodiment, the inner electrode 41 covers the first side 13 of the resistor body 1 and a portion of each of the front surface 11 and the mounting surface 12 of the resistor body 1. In this embodiment, the inner electrode 41 is formed of, for example, a Cu plating layer or an Au plating layer.

The first intermediate electrode 42*a* is a pair of portions which are in electrical conduction with the inner electrode 41 and are separated from each other. The top of the first intermediate electrode 42*a* shown in FIG. 20 is in contact with the adhesive layer 3 and the inner electrode 41. In this embodiment, the first intermediate electrode 42*a* acts to make electrical conduction with the inner electrode 41 and further support the resistor body 1. In this embodiment, the first intermediate electrode 42*a* is formed from a metal plate made of, for example, Cu. The size of the first intermediate electrode 42*a* is larger than those of the chip resistors A1 and A2.

The second intermediate electrode 42*b* is a pair of portions which are in electrical conduction with the inner electrode 41 and the first intermediate electrode 42*a* and are separated from each other. In this embodiment, the second intermediate electrode 42*b* covers the inner electrode 41 and the first intermediate electrode 42*a*. The second intermediate electrode 42*b* is formed from, for example, a Ni plating layer. The outer electrode 43 is a pair of portions which cover the second intermediate electrode 42*b* and are separated from each other. The outer electrode 43 is formed from, for example, a Sn plating layer.

The heat conduction part 6 is a member sandwiched between the pair of electrodes 4 in the direction X shown in FIG. 19. The heat conduction part 6 acts to radiate heat generated from the resistor body 1 outside when the chip resistor A3 is in use. In this embodiment, the top of the heat conduction part 6 shown in FIG. 20 is in contact with the adhesive layer 3. In addition, the side of the heat conduction part 6 in the direction X shown in FIG. 19 is in contact with the first intermediate electrode 42*a*. Therefore, in this embodiment, the heat conduction part 6 has to be an electrical insulator. In addition, the heat conduction part 6 may be made of a heat-resistant material having a relatively high thermal conductivity. Therefore, in this embodiment, the heat conduction part 6 is made of, for example, a polyimide resin.

According to this embodiment, by adjusting the resistance of the resistor body 1 by the plurality of grooves 16, it is possible to adjust the target resistance for each of chip resistors A3 with high accuracy while utilizing an existing production facility. In addition, since the chip resistor A3 does not include the substrate 2, it is possible to reduce production costs. In addition, the electrode 4 of the chip resistor A3 is larger in size than the chip resistors A1 and A2 and the chip resistor A3 further includes the heat conduction part 6. Therefore, it is possible to provide higher efficiency of radiation of heat generated from the resistor body 1 in use of the chip resistor A3 than the chip resistors A1 and A2.

The chip resistors according to the present disclosure are not limited to the above-described embodiments. The specified configurations of various components of the chip resistors according to the present disclosure may be modified in different ways in design.

According to the present disclosure, the plurality of grooves, which does not penetrate through the resistor body, unlike the trimming grooves, is formed in the front surface of the resistor body of the chip resistor. The plurality of grooves can be formed by means of an existing production facility. Therefore, it is possible to adjust the target resistance for each of the above-described chip resistors with higher accuracy while utilizing the existing production facility.

While certain embodiments have been described, these embodiments have been presented by way of example only, and are not intended to limit the scope of the disclosures. Indeed, the novel methods and apparatuses described herein may be embodied in a variety of other forms; furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A chip resistor comprising:

a resistor body having a front surface and a mounting surface which face in opposite directions;

a pair of electrodes which are disposed on both sides of the resistor body with the resistor body sandwiched therebetween and are in electrical conduction with the resistor body; and a protective film covering a portion of the resistor body, wherein a plurality of grooves, which does not penetrate through the resistor body, is formed in the front surface of the resistor body.

2. The chip resistor of claim 1, wherein a direction of the plurality of grooves is a direction perpendicular to a direction of current flowing through the resistor body.

3. The chip resistor of claim 1, wherein an interval between the plurality of grooves is 50 to 100 μm.

4. The chip resistor of claim 1, wherein the resistor body has a serpentine shape when viewed from top.

5. The chip resistor of claim 1, wherein a thickness of the resistor body is 50 to 150 μm.

6. The chip resistor of claim 1, wherein the resistor body is made of an alloy containing Cu, Mn and Ni.

7. The chip resistor of claim 1, wherein the pair of electrodes covers a portion of each of the resistor body and the protective film.

8. The chip resistor of claim 1, wherein the pair of electrodes includes an inner electrode which is in electrical conduction with the resistor body and covers a portion of the protective film, an intermediate electrode covering the inner electrode, and an outer electrode covering the intermediate electrode.

9. The chip resistor of claim 8, wherein the inner electrode is made of a Ni—Cr alloy.

10. The chip resistor of claim 8, wherein the intermediate electrode and the outer electrode are formed from a plating layer.

11. The chip resistor of claim 10, wherein the outer electrode is formed from a Sn plating layer.

12. The chip resistor of claim 10, wherein the intermediate electrode includes a first intermediate electrode covering the inner electrode and a second intermediate electrode covering the first intermediate electrode.

13. The chip resistor of claim 12, wherein the first intermediate electrode is formed from a Cu plating layer.

14. The chip resistor of claim 12, wherein the second intermediate electrode is formed from a Ni plating layer.

15. The chip resistor of claim 1, wherein the protective film is made of a thermosetting resin.

16. The chip resistor of claim 15, wherein the protective film is made of a polyimide resin.

17. The chip resistor of claim 1, further comprising a substrate having a main surface and a mounting surface which face in opposite directions, wherein the resistor body is mounted on the substrate under a state where the mounting surface of the resistor body and the mounting surface of the substrate face each other.

18. The chip resistor of claim 17, wherein the substrate is an electrical insulator.

19. The chip resistor of claim 18, wherein the substrate is made of alumina.

20. The chip resistor of claim 18, wherein the substrate is made of a glass epoxy resin.

21. The chip resistor of claim 20, wherein the resistor body is mounted on the substrate under a state where the resistor body is buried in the substrate.

22. The chip resistor of claim 17, further comprising an adhesive layer sandwiched between the mounting surface of the substrate and the mounting surface of the resistor body.

23. The chip resistor of claim 22, wherein the adhesive layer is an electrical insulator.

24. The chip resistor of claim 23, wherein the adhesive layer contains an epoxy resin.

25. A method for manufacturing a chip resistor, comprising:

preparing a sheet resistor body which includes a plurality of resistor body regions and has a front surface and a mounting surface which face in opposite directions;

forming a plurality of grooves for resistance adjustment for each of the resistor body regions, the plurality of grooves being formed in front surfaces of the plurality of resistor body regions and not penetrating through the resistor body regions;

forming a protective film body covering a portion of the plurality of resistor body regions in the front surface of the sheet resistor body;

forming a conductive layer in an exposed portion of the plurality of resistor body regions, which is not covered by the protective film body, in the front surface of the sheet resistor body; and dividing the sheet resistor body into segments for the resistor body regions to form a pair of inner electrodes, which are in electrical conduction with the resistor body regions, on both sides of each of the resistor body regions with the resistor body regions sandwiched between the inner electrodes.

26. The method of claim 25, wherein the act of forming a plurality of grooves includes forming a trimming groove for each of the resistor body regions, the trimming groove penetrating through the resistor body region.

27. The method of claim 25, wherein the act of forming a plurality of grooves includes forming the plurality of grooves by means of a laser trimming device.

28. The method of claim 27, wherein the act of forming a plurality of grooves includes forming the plurality of grooves for each of a plurality of sections set in each of the resistor body regions.

29. The method of claim 28, wherein the act of forming a plurality of grooves includes forming the plurality of grooves in an order from a section located in an outer side of the resistor body region toward a section located in an inner side of the resistor body region.

30. The method of claim 29, wherein the act of forming a plurality of grooves includes forming the plurality of grooves alternately in an order of a section located between the center of the resistor body region and one of the pair of inner electrodes and a section located between the center of the resistor body region and the other of the pair of inner electrodes.

31. The method of claim 25, wherein the act of forming a conductive layer includes forming the conductive layer by means of deposition or printing.

32. The method of claim 31, wherein the deposition is a sputtering.

33. The method of claim 25, further comprising forming an intermediate electrode covering the pair of inner electrodes and an outer electrode covering the intermediate electrode for each of the segments.

34. The method of claim 33, wherein the act of forming an intermediate electrode and an outer electrode includes forming the intermediate electrode and the outer electrode by means of plating.

35. The method of claim 25, further comprising bonding a sheet substrate to the mounting surface of the sheet resistor body.

36. The method of claim 35, wherein the act of bonding a sheet substrate includes bonding the sheet substrate by applying an adhesive made of an epoxy resin to the mounting surface of the sheet resistor body or by disposing an adhesive sheet made of a glass epoxy resin on the mounting surface of the sheet resistor body.

* * * * *